United States Patent [19]

Bitsch et al.

[11] 4,142,081

[45] Feb. 27, 1979

[54] CONTACT SYSTEM FOR HIGH-VOLTAGE POWER CIRCUIT BREAKERS

[75] Inventors: Rainer Bitsch; Heiner Marin, both of Berlin, Fed. Rep. of Germany

[73] Assignee: Siemens Aktiengesellschaft, Munich, Fed. Rep. of Germany

[21] Appl. No.: 833,353

[22] Filed: Sep. 14, 1977

[30] Foreign Application Priority Data

Sep. 30, 1976 [DE] Fed. Rep. of Germany ..... 2644421

[51] Int. Cl.[2] ..... H01H 1/50

[52] U.S. Cl. ..... 200/251; 200/290

[58] Field of Search ..... 200/48 R, 250, 251, 200/245, 246, 247, 276, 290

[56] References Cited

U.S. PATENT DOCUMENTS

| | | | |
|---|---|---|---|
| 2,059,702 | 11/1936 | Matthias | 200/250 |
| 2,092,478 | 9/1937 | Sommermeyer | 200/250 |
| 2,871,323 | 1/1959 | Mahler et al. | 200/250 |
| 3,154,662 | 10/1964 | Heupel et al. | 200/250 |
| 3,158,721 | 11/1964 | Delaney | 200/250 |
| 3,991,290 | 11/1976 | Bayles et al. | 200/250 |

FOREIGN PATENT DOCUMENTS

| | | | |
|---|---|---|---|
| 2533801 | 2/1977 | Fed. Rep. of Germany | 241/250 |

*Primary Examiner*—William T. Dixson, Jr.
*Assistant Examiner*—Joseph Man-Fu Moy
*Attorney, Agent, or Firm*—Kenyon & Kenyon, Reilly, Carr & Chapin

[57] ABSTRACT

A contact system for a high-voltage power circuit breaker wherein the contact system includes first and second hollow contacts which have end faces which rest against one another under pressure in the "on" position or condition of the breaker and which separate to form a gap in the "off" position of the breaker. In accordance with the invention, the contact system is further provided with a number of spring-loaded contact means arranged at the end face of one of the contacts for forming with the current path of that contact current loops for aiding the spring force provided by the contact means.

3 Claims, 1 Drawing Figure

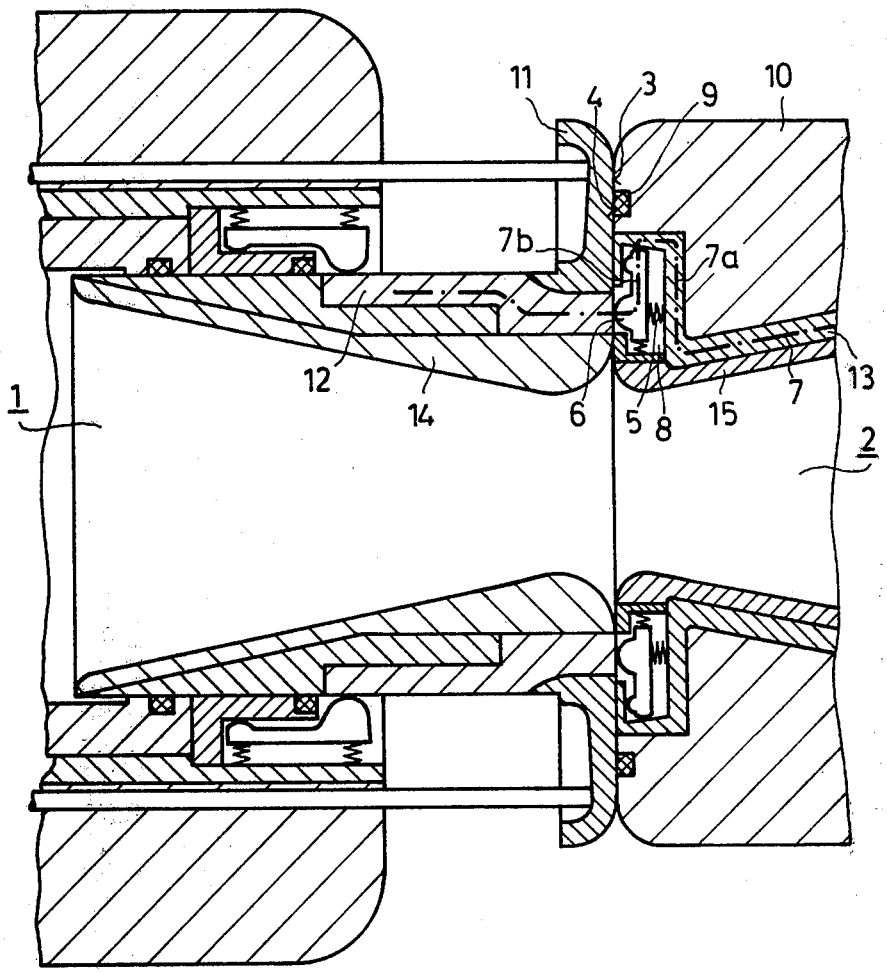
11
4
3
9
10
7b
7a
12
14
6
5
8
15
7
13
1
2

CONTACT SYSTEM FOR HIGH-VOLTAGE POWER CIRCUIT BREAKERS

BACKGROUND OF THE INVENTION

1. Field of the Invention

This invention relates to a contact system for a high-voltage power circuit breaker wherein the system includes first and second contacts which are hollow for permitting discharge of the switching gases and which have end faces which, in the "on" position or condition of the breaker, rest against one another under pressure and which, in the "off" position or condition of the breaker, are separate from one another to form a gap therebetween.

2. Description of the Prior Art

German Pat. No. 1,041,569 discloses a compressed-air circuit breaker wherein one contact of the breaker is hollow and is contacted in the "on" position of the breaker by a spring-loaded contact element which is arranged at a stationary countercontact. The hollow contact, which is movable, is, in turn, loaded by a compression spring. In this known contact arrangement, substantially the same contact force is provided for all currents that flow through the arrangement.

It is an object of the present invention to provide a contact system of the above type which can handle relatively large currents without the need to provide loading springs capable of exerting increased pressures.

SUMMARY OF THE INVENTION

In accordance with the principles of the present invention, the above and other objectives are realized in a contact system of the above type by further providing therein a number of spring-loaded contact means arranged at the end face of at least one of the contacts for forming with the current path of that contact current loops for aiding the spring force of the contact means.

With the present invention it is thus possible to employ contacts with a relatively small mass and to load the contacts with springs, the force of which is designed so that chattering of the contacts can be largely prevented. Moreover, the current loop which aids the spring force provided by the contact means begins to be effective at larger currents, so that the contact system is now able to reliably transmit larger currents.

The amount of current capable of being transmitted between two contacts depends on the number of metallic contact points therebetween. Since in the present system use of a number of the contact means provides a number of contact points, the system can, therefore, transmit heavier currents better than conventional pressure contacts which, as a rule, employ only a single contact point. The contact system of the present invention can, preferably, be used for fast high-voltage power circuit breakers, for synchronous breakers and for commutation switches of current-limiting switching elements.

In the embodiment of the contact system to be discussed hereinafter, the one contact is provided with recesses which are uniformly distributed over its circumference for receiving the contact means. Also, each such contact includes a contact element which is tiltably supported transversely to the axis of the contact.

BRIEF DESCRIPTION OF THE DRAWING

The above and other features and aspects of the present invention will become more apparent upon reading the following detailed description in conjunction with the accompanying drawing in which the sole FIGURE thereof illustrates schematically the cross section of a contact system in accordance with the principles of the present invention.

DETAILED DESCRIPTION

FIG. 1 shows a contact system in accordance with the principles of the present invention. The contact system includes two hollow, nozzle-shaped contacts 1, 2 having respective end faces 3, 4 which in the "on" position of the breaker rest against one another under pressure. In the "off" position of the breaker, the aforesaid end faces 3, 4 are disposed at a distance from one another to form a gap therebetween.

The contact 2 is provided at its end face 3 with a number of contact elements 6 which are loaded by springs 5 and which, together with the current path 7 of the contact 2, form current loops which aid the spring force being applied to the contact elements 6. More particularly, when current flows along the dash-dotted line, a force is generated in the regions 7*a* and 7*b* which acts in a direction to expand the current loops and, thus, which aids the force of the springs 5.

The contact elements 6 are seated in recesses 8 which are uniformly distributed over the circumference of end face 3 of the contact 2. The contact elements 6 are tiltably supported in the recesses 8 transversely to the axis of the contact.

To permit the contact system shown in the FIGURE to be used for blast chamber breakers, a sealing ring 9 is provided which seals the end faces 3 and 4 of the contacts in a gas tight manner when resting against each other under pressure. In such case, the movable contact 1 acts as a blast valve which sets the quenching gas flow in motion.

As shown in the FIGURE, the different elements of the contacts 1 and 2 are formed of different materials. In particular, the bodies 10 and 11 of the contacts, which bodies function as support elements and, hence, require greater mechanical strength, may be formed of an electrically conductive material of lower specific gravity. The parts 12, 13 of the contacts, on the other hand, which function to provide current conduction, may be formed of copper. The inner layers 14, 15, which define the inner cavities of the contacts may comprise heat-resistance or burn-proof material, e.g., tungsten-copper or graphite. Furthermore, the individual materials can be coated with insulating material for forming the intended current loop or may be insulated from each other by oxide layers.

What is claimed is:

1. In a contact system for high voltage power circuit breakers wherein said contact system includes two contacts which are hollow for discharging gases and which have end faces which rest against one another under pressure in the "on" condition of the breaker and are disposed at a distance from one another to form a gap in the "off" condition of the breaker, the improvement comprising:

at least one of said contacts having recesses in its end face, said recesses being distributed around the circumference of said end face; and spring-loaded contact means arranged in said recesses to form with the current path of that contact current loops to reinforce the spring force provided by said contact means.

2. In a contact system in accordance with claim 1, the improvement wherein:

each of said contact means includes a contact element which is tiltably supported transversely to the axis of that contact.

3. In a contact system in accordance with claim 2, the improvement wherein:

each of said contact means further includes a spring arranged in contact with the contact element of that contact means.

* * * * *